United States Patent [19]

Bell et al.

[11] Patent Number: 4,543,028

[45] Date of Patent: Sep. 24, 1985

[54] DUMP APPARATUS FOR TRASH CONTAINERS

[75] Inventors: James L. Bell, Lake Orion; John Horvath, Inkster, both of Mich.

[73] Assignee: Bell Equipment Company, Troy, Mich.

[21] Appl. No.: 570,603

[22] Filed: Jan. 13, 1984

[51] Int. Cl.[4] ..... B65F 3/02

[52] U.S. Cl. ..... 414/408; 414/420; 414/549; 414/555; 414/733

[58] Field of Search ..... 414/406, 408, 409, 420, 414/707, 710, 711, 733, 549, 555

[56] References Cited

U.S. PATENT DOCUMENTS 3,342,358 9/1967 French et al. ..... 414/710 X 4,219,298 8/1980 Stragier et al. ..... 414/409

OTHER PUBLICATIONS

Drawing of Part. No. 500900 S.A.L., (Side Automatic Loader) 1000–Top Assembly.

*Primary Examiner*—Robert G. Sheridan

*Attorney, Agent, or Firm*—Harness, Dickey & Pierce

[57] ABSTRACT

A trash dumping apparatus adapted to be mounted on a trash pick-up truck alongside the open-top, trash-receiving body thereof operative automatically by unique mechano-hydraulic means to pick-up trash containers and to dump the contents thereof in the body, the mechano-hydraulic means being strong and rugged in construction, durable and relatively trouble free in use to minimize maintenance cost and consequential down time of the vehicle otherwise necessary for servicing and repair of the equipment.

9 Claims, 13 Drawing Figures

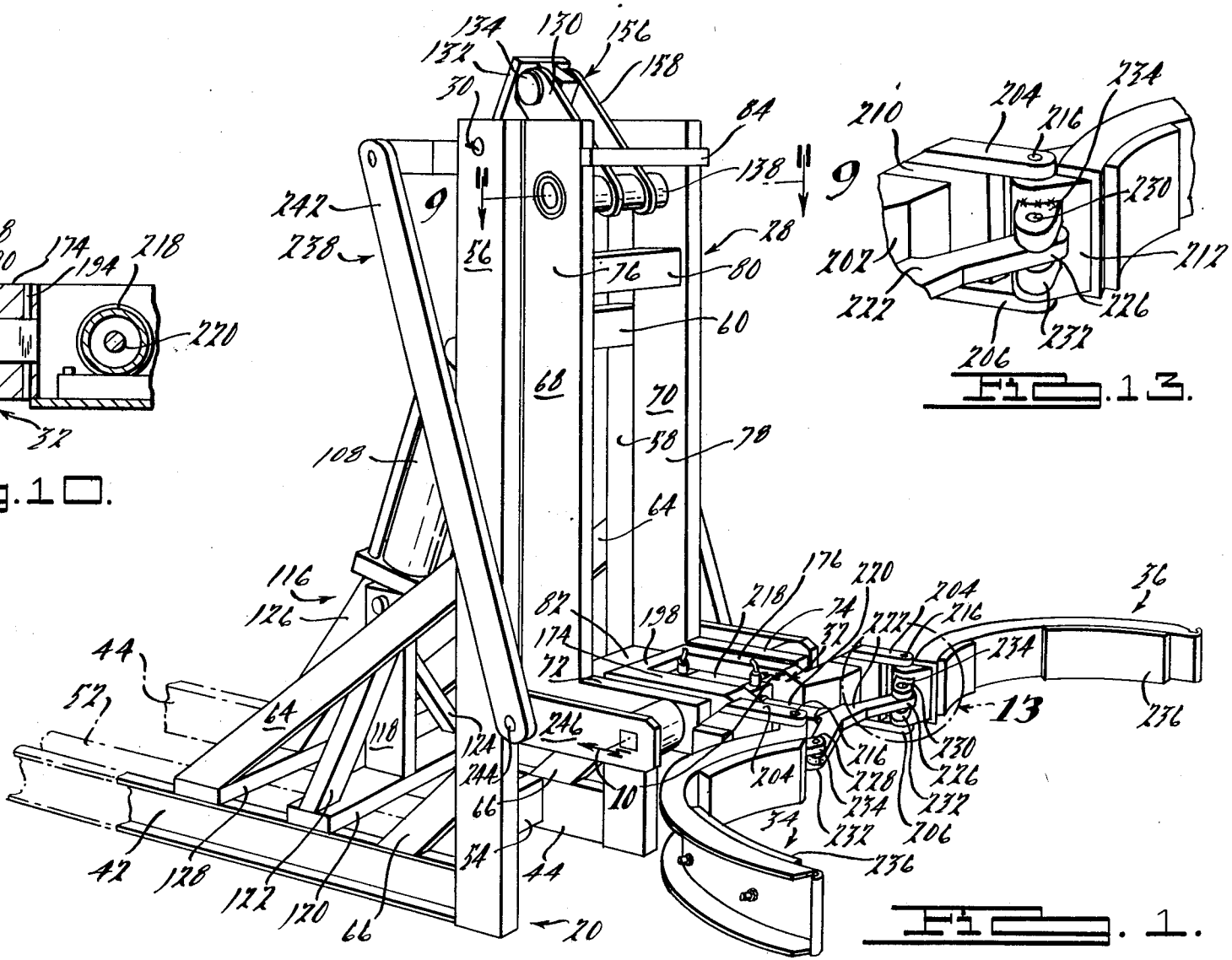
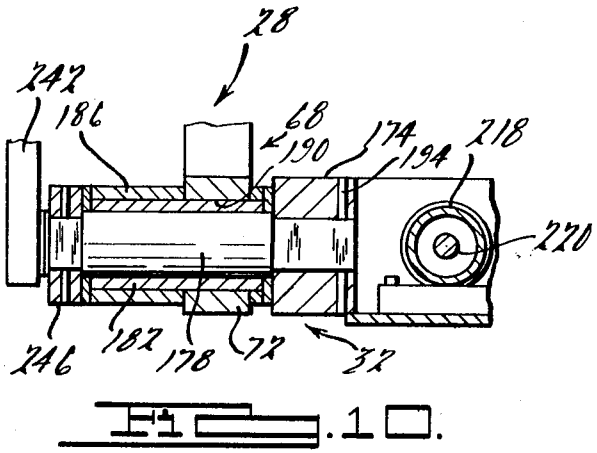

DUMP APPARATUS FOR TRASH CONTAINERS

BACKGROUND OF THE INVENTION

It is conventional practice to empty trash containers into the open-top, trash-receiving body of a trash pick-up truck by means of an automatically operable mechanism attached to the truck alongside the body. This equipment is used extensively in cities where residences and possibly at least certain commercial and industrial establishments are provided by the municipality with relatively large trash containers of uniform size and shape. Periodically, usually about once a week, the residences and other establishments place their trash containers in a suitable location, as at curb-side or in an alley, and the truck is driven from one trash container to the next. As the truck stops at each trash container, the mechanism moves laterally away from the truck, picks up the container, then retracts to its normal position alongside the truck and swings the container upwardly to an upside down position over the trash receiving body so that the trash in the container falls by gravity into the body. These motions are then repeated in reverse order to return the empty container to its original location.

The loaded trash containers frequently are heavy and the mechanism used to dump the containers are subject to great stress and abuse in use, with the result that they heretofore have required frequent servicing and repair which means that the trucks themselves are often out of service sometimes for extensive periods of time. For the most part, these dump mechanisms have been operated by a multiplicity of hydraulic cylinders which are controlled by valves in the hydraulic circuits that served the cylinders and the valves in turn are energized by limit switches disposed at strategic locations as required to limit travel of the various moving parts of the equipment. The apparatus necessarily must operate rapidly so that, in addition to the physical abuse to which the moving parts of the apparatus are subjected in use, the numerous power cylinders and valves are subject to frequent breakdowns and the limit switches require frequent repositioning and adjustment and not infrequently they are damaged to such an extent not only by physical abuse but also by weather and other environmental conditions to which they are exposed, that they cannot be repaired but must be replaced by new parts.

SUMMARY OF THE INVENTION

The present invention is adapted to perform essentially the same basic motions as the previous apparatus; however, while it has essentially the same mode of operation, it is more durable in use due at least in part to the fact that the various motions are mechanically interlocked in such a way that the number of hydraulic power actuators is kept to a minimum and the various moving parts of the apparatus are constructed and mechanically interrelated in such a way that they are better able to withstand the physical abuse to which the apparatus inevitably is subjected in use. Moreover, the equipment is less expensive to manufacture and to maintain than heretofore and it is more efficient in operation.

DESCRIPTION OF THE DRAWINGS

FIG. 1 is an isometric view of a trash dumping apparatus embodying the present invention;

FIG. 8 is an enlarged fragmentary, horizontal sectional view taken on the line 8—8 of FIG. 3;

FIG. 9 is an enlarged fragmentary, horizontal sectional view taken on the line 9—9 of FIG. 1;

FIG. 10 is an enlarged fragmentary, horizontal sectional view taken on the line 10—10 of FIG. 1;

FIG. 13 is an enlarged view of the portion of FIG. 1 enclosed by the circle 13.

DESCRIPTION OF THE PREFERRED EMBODIMENT

Figure 2:
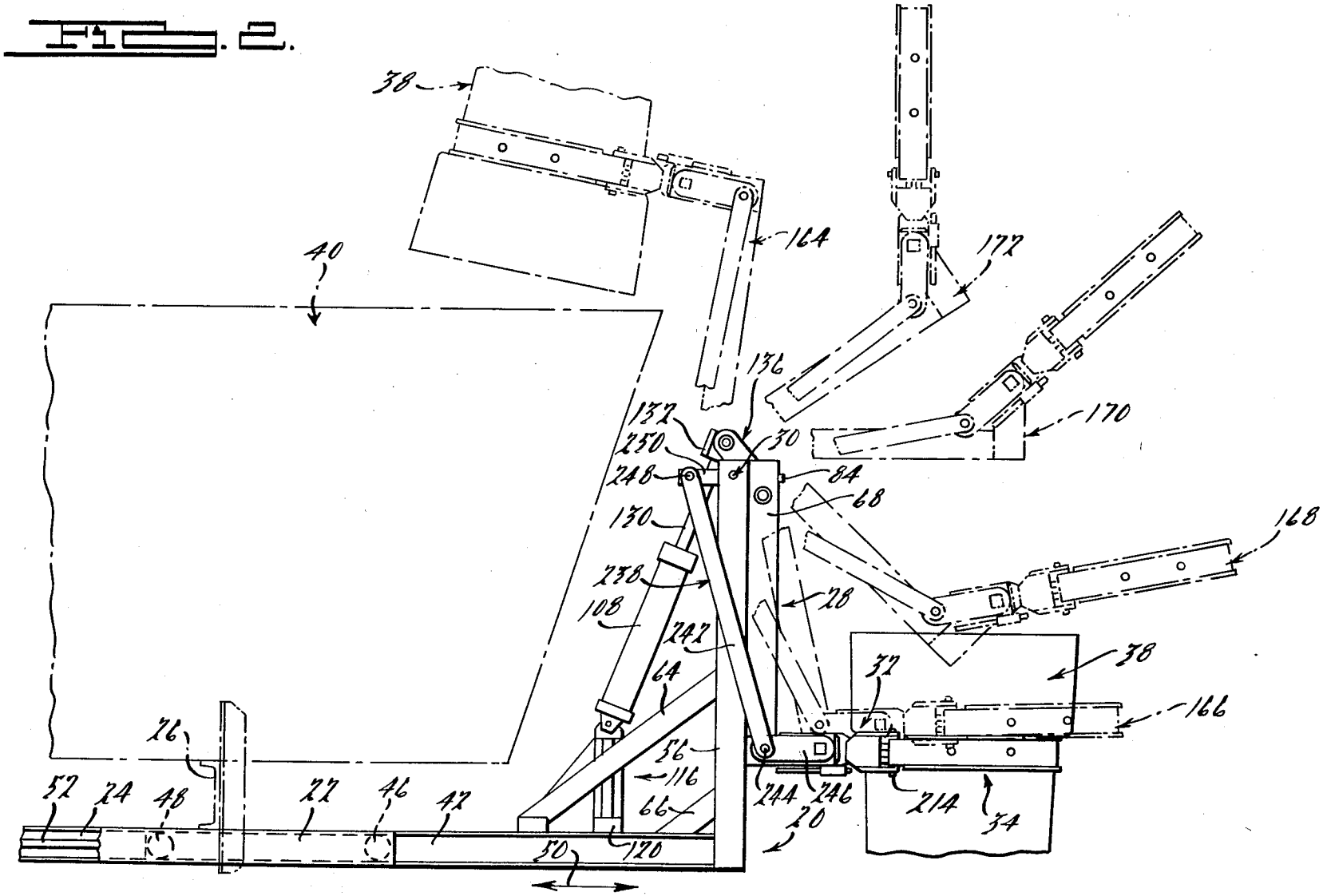
FIG. 2 is a side elevational view of the same particularly showing the manner in which the apparatus is mounted on a trash pick-up truck of a type with which it is adapted to be associated in use and showing also the sequence of motions that take place as the apparatus goes through its operating cycle.

As perhaps best shown in FIG. 2, the trash dumping apparatus of this invention comprises a main supporting frame, designated generally by the numeral 20 and sometimes referred to as an advance frame, which is adapted to be mounted for limited horizontal sliding movement on a pair of fixed stationary parallel rails 22 and 24 welded or otherwise fixed to the chassis of the truck with which the apparatus of this invention is associated. A fragmentary portion of the chassis is shown at 26. The upper end of a power actuated lift frame 28 is pivoted at 30 to the advance frame 20 for vertical swinging movement between the extreme lower position shown by full lines in FIG. 2 and the extreme raised position shown in phantom lines. Pivoted to the swinging lower end of the lift frame 28 for independent oscillatory movement relative thereto is a rocker frame 32 having clamping arms 34 and 36 that are power actuated between open and closed positions and are operative to clampingly engage and hold a trash can or container 38 as also shown in FIG. 2.

In operation, the advance frame 20 advances to move the open clamping arms 34 and 36 into embracing relation with a trash can 38. The arms 34 and 36 are then closed to grip the can and the lift frame 28 is swung upwardly to dump the contents of the can. Simultaneously, or as a preliminary operation, the advance frame 20 is retracted so that, by the time the can is swung fully overhead, it is over the open top of the truck body. Lever means are provided that interact between the advance frame 20 and the rocker frame 32 to turn the latter first in one direction to keep it and the trash can carried thereby generally horizontal until the can reaches a position over the truck body and then to turn the rocker frame in the opposite direction to flip the can upside down to dump its contents into the truck body. All of these actions occur in proper timed sequence through a unique mechano-hydraulic means that utilizes mechanical operation for most of the action and that keeps the hydraulic operation to a minimum to avoid as much as possible the problems and deficiencies recited above for prior apparatuses of the type involved here.

The fixed truck rails 22 and 24 extend crosswise of the vehicle chassis 26; and they are spaced sufficiently apart to accommodate the advance frame 20 therebetween. A fragmentary portion of the open-top, trash-receiving body of the truck is shown at 40 in FIG. 2.

The fixed, stationary rails 22 and 24 are channel shaped and are disposed facing each other with the flanges of each rail extending toward the other to define spaced opposed or confronting ways. On the other hand, the advance frame 20 has a pair of laterally spaced channel-shaped rails 42 and 44 which are disposed with their flanges extending outwardly each away from the other, as perhaps best shown in FIG. 1, and in such mutually spaced relation that they fit snugly but slidably between the two fixed rails 22 and 24. All of the channel rails 22, 24, 42 and 44 are preferably of the same width so that the flanges of each truck channel are disposed directly opposite and substantially flush with a respective frame channel, and each pair of confronting channels define a generally rectangular way therebetween in which front and rear rollers 46 and 48 travel when the frame 20 moves laterally to and from the truck body 40 as indicated by the arrow 50 in FIG. 2.

In practice, the axles of the front rollers 46 are fixed to and carried by the truck channels 22 and 24 and the axles of the rear rollers 48 are fixed to and carried by the frame channels 42 and 44. The two front rollers 46 extend laterally inwardly of the channels 22 and 24 and into the frame channels 42 and 44. On the other hand, the rear rollers 48 extend laterally outwardly of the channels 42 and 44 and into the truck channels 22 and 24. Thus, the front rollers 46 travel on the flanges of the frame channels 42 and 44 and the rear rollers 48 travel on the flanges of the truck rails 22 and 24 to support the advance frame 20 for free sliding movement back and forth on the truck rails 22 and 24 and laterally with respect to the truck body 40. It is desirable, of course, that the front and rear rollers 46 and 48 be spaced sufficiently apart to adequately support the advance frame 20 and its adjuncts for the full limit of their travel relative to the truck body 26.

As suggested, the advance frame 20 carries the trash container gathering and dumping mechanism of this invention; and, in practice, it advances or moves laterally away from the truck body 40 to pick up a trash container and then retracts to a position proximate to the truck body 40 (FIG. 2) during the dumping operation so that the container contents fall by gravity into the body. Back and forth actuation of the advance frame 20 is achieved by a power cylinder 52 which interconnects the advance frame 20 and the truck chassis 26. If desired, suitable stops (not shown) may be provided for limiting the travel of the advance frame 20 on the fixed stationary rails 22 and 24. Transverse frame members 54 extending between and welded or otherwise fixed to the two advance frame rails 40 and 42 hold the latter in fixed, uniformly spaced relation. Only one transverse frame member 54 is shown in FIG. 1, but it will be readily apparent that any desired number of cross members may be provided between the rails 42 and 44 as required to hold the latter rigidly spaced with respect to each other and parallel to the stationary rails 22 and 24. Laterally spaced, vertical members 56 and 58 of the advance frame 20 at the forward ends and welded or otherwise fixed to respective rails 42 and 44 carry the moving parts of the dump mechanism. Cross frame members 60 and 62 extending between and welded or otherwise fixed to the upright members 56 and 58 hold the latter rigidly apart and parallel to each other; and each upright member 56 and 58 is rigidly held at right angles to its respective rail 42 and 44 by diagonal struts 64 and 66.

Figure 5:
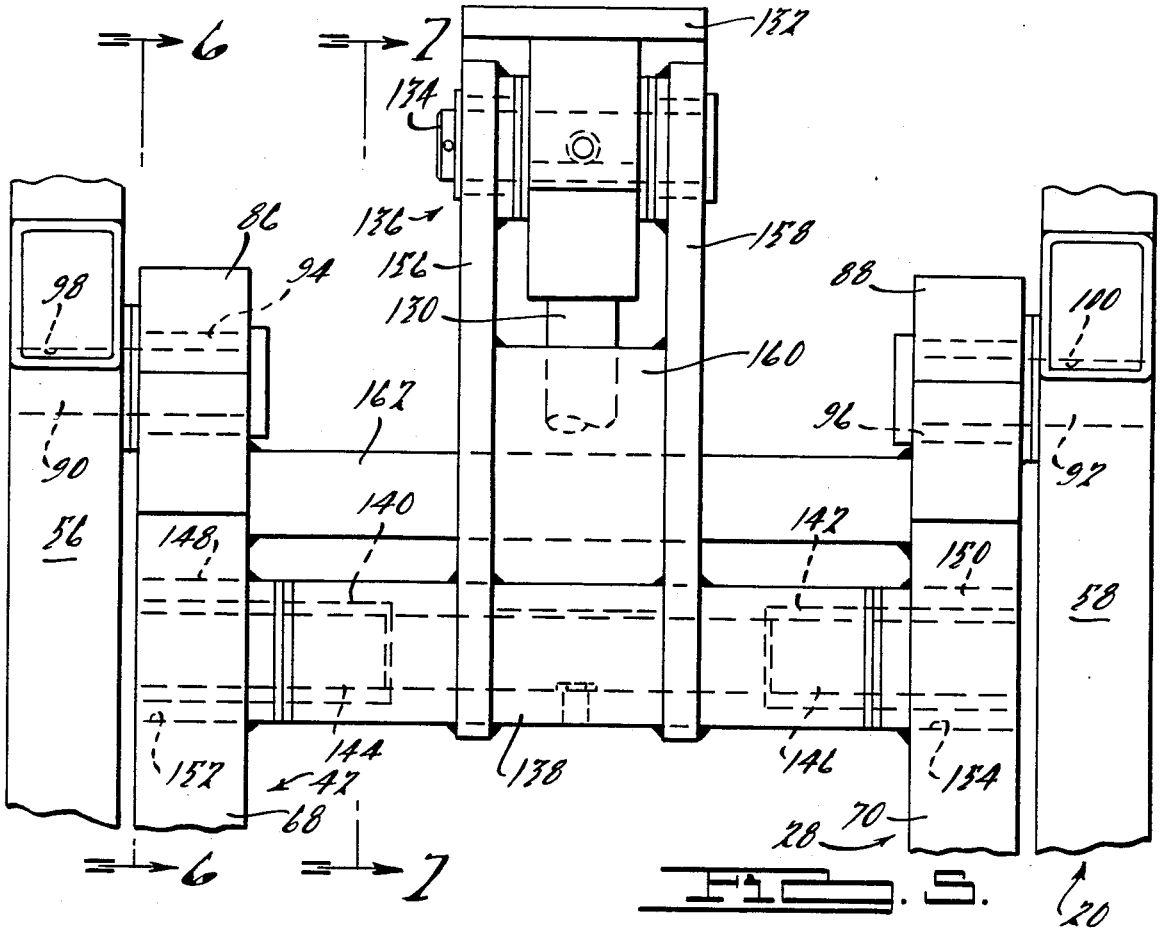
FIG. 5 is an enlarged fragmentary view looking in the direction of the arrow "C" in FIG. 3.

The lift frame 28 is disposed in front of and pivoted at 30 to the upright members 56 and 58 of the advance frame 20. More particularly, the lift frame 28 comprises a pair of L-shaped, parallel, structural members 68 and 70 arranged with the lower horizontal members 72 and 74 thereof extending forwardly from the vertical members 76 and 78 and held rigidly apart by cross members 80 and 82 extending therebetween and welded or otherwise fixed thereto. The cross member 80 is disposed adjacent to but spaced substantially below the upper ends of the vertical members 76 and 78; and the other cross member 82 is disposed substantially at the juncture of the two vertical members and their respective horizontal frame members 72 and 74. Thus, the portions of the vertical members 76 and 78 above the cross member 80 are essentially free-standing except for a second cross frame member 84 that limits upward pivotal or swinging movement of the lift frame as will be hereinafter explained. Similarly, the portions of the horizontal frame members 72 and 74 extending forwardly of the cross frame member 82 are essentially free standing. The upper ends of the vertical frame members 76 and 78 are disposed substantially flush with the upright members 56 and 58 of the advance frame 20; and mounting blocks 86 and 88 on the rearward edges of the frame members 76 and 78 project between the vertical advance frame members 56 and 58 in relatively closely spaced parallel relation with respect thereto. Pivots 90 and 92 extend through and are journaled for rotation in supporting bushings 94 and 96 in respective mounting blocks 86 and 88 and project into close fitting holes 98 and 100 in the advance frame members 56 and 58 (FIG. 5). Cross pins 102 hold the pivots 90 and 92 fixed to the advance frame members 56 and 58 while the bushings 94 and 96 turn freely on the pivots 90 and 92 to permit free swinging movement of the lift frame 28. In practice, the lift frame 28 hangs downwardly from the pivots 90 and 92 with the lift frame members 76 and 78 parallel to but forwardly of the adjacent advance frame members 56 and 58. The lower portions of the lift frame vertical members 76 and 78 seat rearwardly against a rubber bumper-facing 106 on the advance frame cross member 62.

Figure 3:
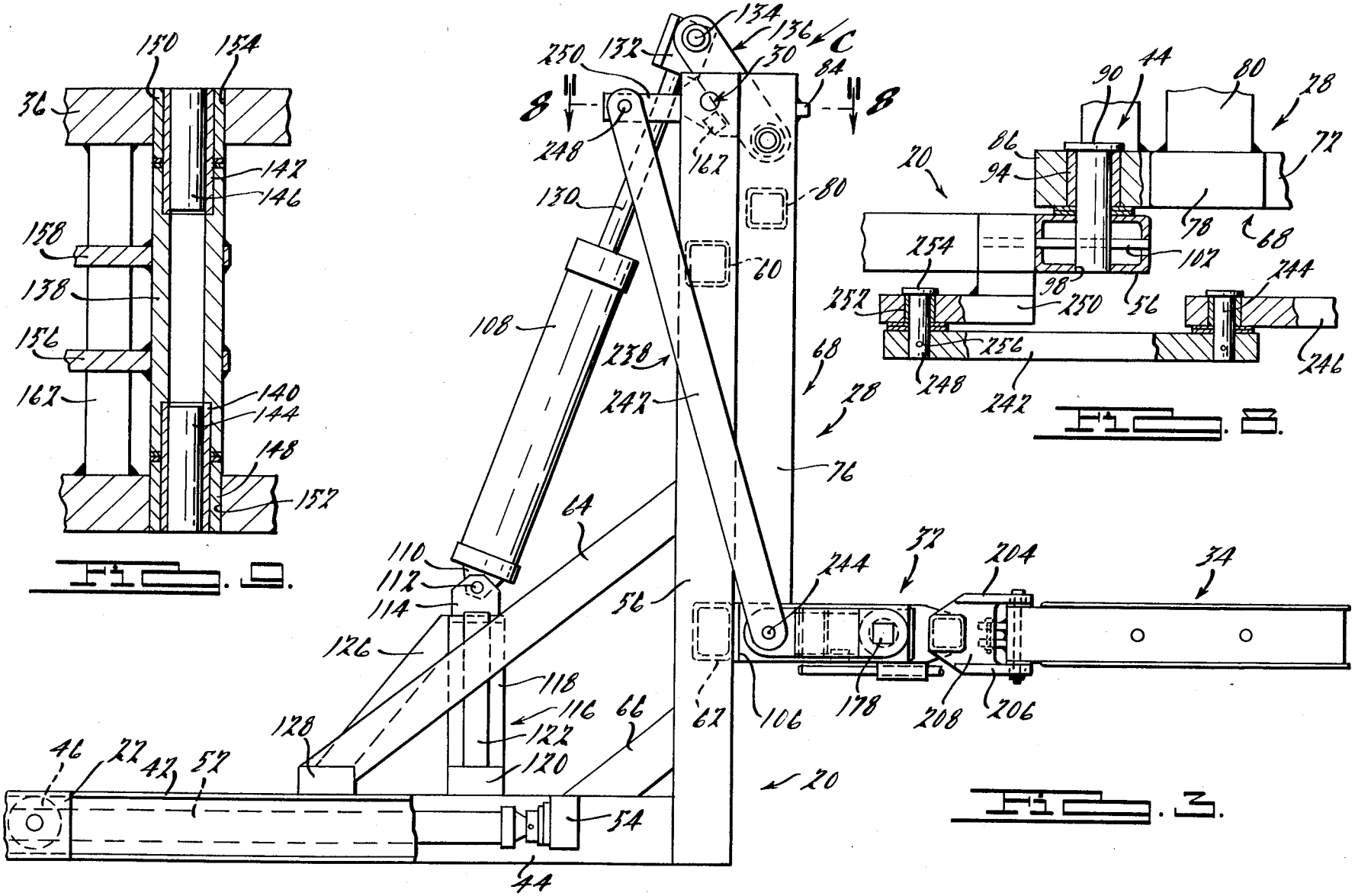
FIG. 3 is an enlarged view similar to FIG. 2 but showing the trash dumping apparatus of this invention only and the parts thereof in their normal non-operating position.
Figure 6:
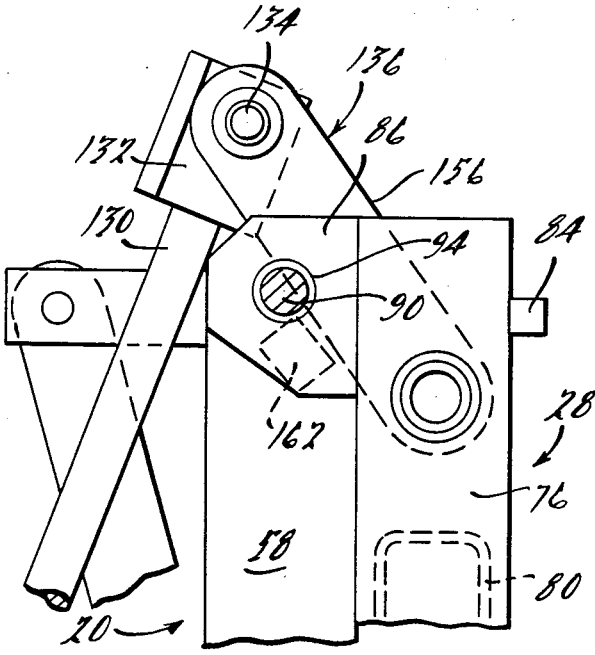
FIG. 6 is a fragmentary, vertical sectional view taken on the line 6—6 of FIG. 5.
Figure 7:
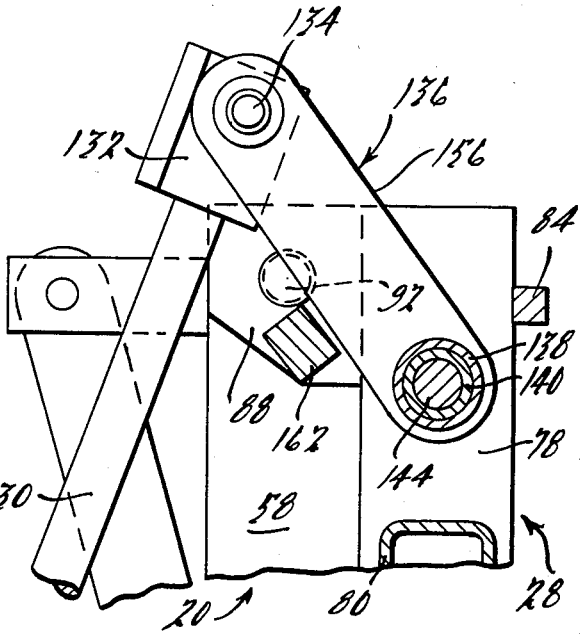
FIG. 7 is a fragmentary, vertical sectional view looking in the direction of the arrows 7—7 of FIG. 5.

The lift frame 28 is swingable vertically on the pivots 90 and 92 by a power cylinder 108 which is mounted on the base portion of the advance frame 20 behind the vertical members 56 and 58. As shown in FIG. 3, the bottom or rearward end of the power cylinder 108 is formed with a pair of laterally spaced longitudinal lugs 110 that embrace and are connected by a pivot 112 to a mounting flange 114 on a suitable fixed standard 116 carried by and upstanding from the advance frame 20. As best shown in FIGS. 1 and 3, the standard 116 comprises an upright structural member 118 which is welded or otherwise fixed to a cross frame member 120 surmounting and welded to the advance frame rails 42 and 44. A pair of laterally extending diagonal struts 122 and 124 welded to the members 118 and 120 reinforce the upright member 118 from the sides and a third strut 126 extending diagonally rearwardly between the upright structural member 118 and a second cross frame member 128 on the advance frame rails 42 and 44 reinforce and support the member 118 from the rear. The piston rod 130 of the power cylinder 108 carries a connector 132 which is fastened by a pivot 134 to a compound crank arm 136 welded to and extending radially from a sleeve 138 which is supported for rotation by bushings 140 and 142 journaled on aligned trunnions 144 and 146 press fitted into strengthening and reinforcing sleeves 148 and 150 which in turn are pressed into aligned openings 152 and 154, respectively, provided in the upright lift frame members 76 and 78. The compound crank arm 136 comprises two laterally spaced links 156 and 158 and a flat bearing plate 160 interconnecting the links at the undersides thereof. In use, the plate 160 normally rests on and is supported by a bar 162 which extends between and is welded to the lift frame mounting blocks 86 and 88 as shown in FIGS. 6 and 7.

In operation, the power cylinder 108 is operated to retract the piston rod 130, the latter swings the crank arm 136 counterclockwise, as viewed in FIGS. 1 and 3, and the crank arm 136 in turn bears downwardly on and acts through the cross bar 162 to swing the lift frame 28 upwardly or counterclockwise on the trunnions 144 and 146. The stroke of the piston rod 130 is sufficiently long to swing the lift frame 28 through substantially 180° from the normally dependent position shown by full lines in the drawings to a substantially fully upright position shown at 164 by phantom lines in FIG. 2. Contrariwise, when the piston rod 130 is advanced from the fully retracted position, it permits the crank arm 136 to turn in a clockwise direction under the weight of the lift frame 28 which progresses through the successive phantom line positions shown in FIG. 2 to the fully lowered position in which it rests against the bumper pad 106. When fully advanced, the piston rod 130 may lift the crank arm 136 completely off of the cross bar 162 as shown in FIG. 3 so that the lift frame 28 is clear of any restraining action by the power cylinder 108 and so that the full weight of the lift frame is available to return it to the fully lowered position in which it has to be to pick up a trash container, as will be hereinafter apparent. Then, as the piston rod 130 is retracted at the beginning of an operating cycle, it pulls the crank arm 136 counterclockwise until it engages the cross bar 162. Continued retraction of the piston rod 114 then causes the lift frame 28 to swing upwardly progressively through the phantom line positions designated in FIG. 2 generally by the numerals 166, 168, 170 and 172. By the time the lift frame 28 reaches approximately the position indicated by the numeral 172, the crank arm 136 disengages and moves away from the cross bar 162 as the trunnions 144 and 146 move overcenter rearwardly past the pivots 90 and 92 and the power cylinder exerts essentially a straight downward pull on the lift frame through the crank arm 136. Conversely, when the piston rod 130 begins to advance, it repeats the above operations in reverse order. The lift frame 28 never moves past the fully vertical position during its upward swinging movement so that the weight of the lift frame and its adjuncts plus the upward thrust from the power cylinder 108 starts the lift frame swinging downwardly on the return portion of the cycle. By the time the lift frame 28 reaches the substantially horizontal position designated by the numeral 170 in FIG. 2, the full weight of the lift frame is utilized to complete the downward swinging movement thereof. It will be readily appreciated, however, that relatively soon after the lift frame 28 begins to swing downward, the cross bar 162 moves against the bearing plate 160 of the crank arm 120 and that, thereafter, downward swinging movement of the lift frame is snubbed by the power cylinder 108. The rate at which the piston rod 130 is extended during this phase of the operation can, of course, be controlled by suitable valving (not shown) with which power cylinders of the type involved here are conventionally equipped to regulate the flow of hydraulic liquid to and from the cylinder and to control the flow of fluid to one side or the other of the piston at the end of the rod 130. This is particularly significant in the case of the present application since limit switches are not required to regulate and control the stroke of the piston and the apparatus therefore is not affected, insofar as the swinging movement of the lift frame 28 is concerned, by limit switches which sometimes tend to stick and become inoperative in the environment in which the apparatus is used, or alternatively, get out of adjustment under the relatively heavy impact forces that are generated by the moving parts that would necessarily have to be utilized to operate the limit switches. Instead, the piston that actuates the rod 130 is permitted to bottom out against cushioning means at the ends of the power cylinder 108. The full stroke of the piston can thus be utilized to operate the lift frame 28. If desired, suitable fixed stops (not shown) also can be provided to limit the swinging movement of the lift frame and to prevent overtravel thereof that might damage the apparatus in some way. In the present construction, as indicated previously, the lift frame cross member 84 engages the crank arm 136 in the fully upright position 164 of the lift frame 28 and thus serves as a stop to limit farther counterclockwise swinging movement of the lift frame.

Figure 4:
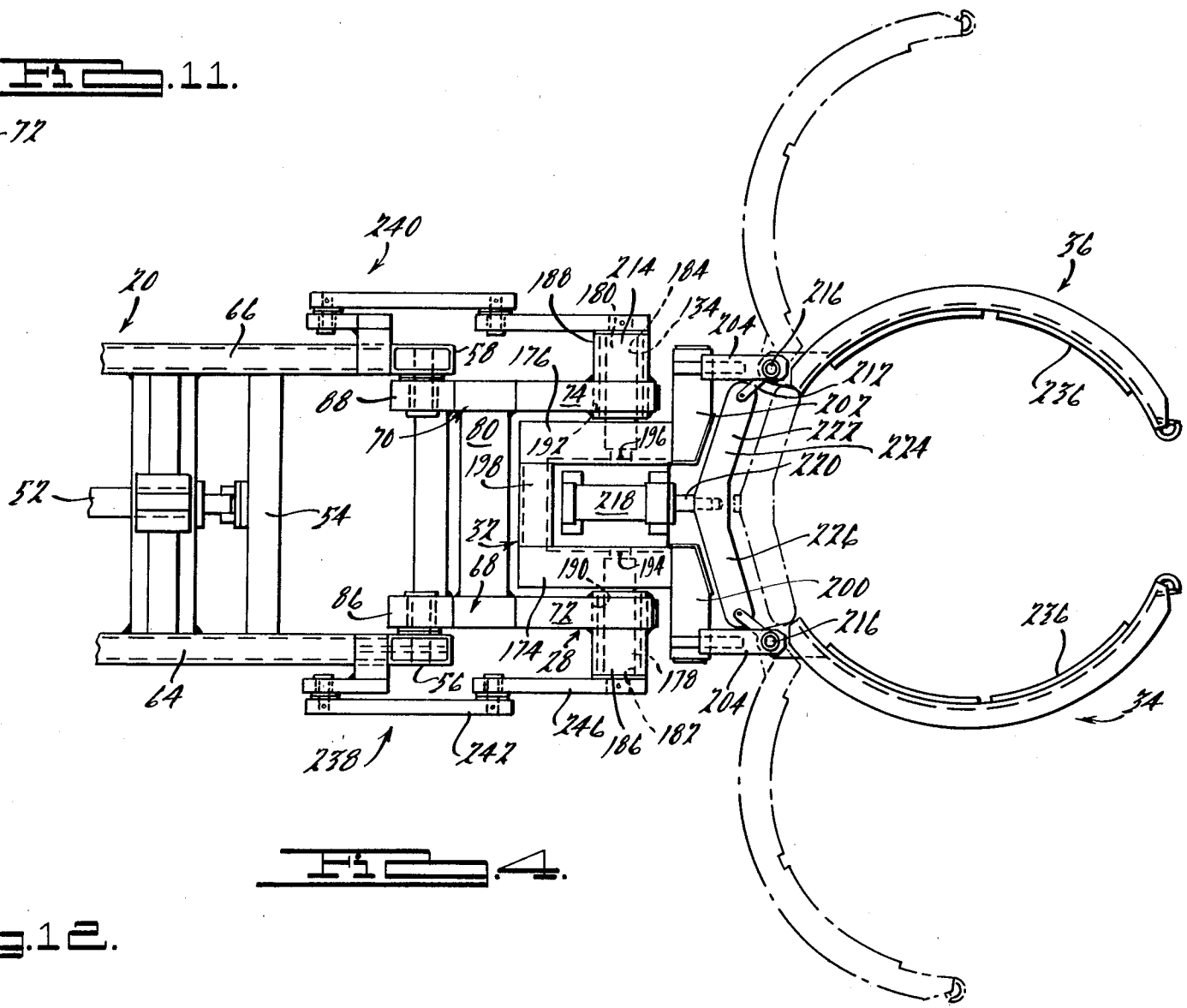
FIG. 4 is a top plan view of the apparatus.
Figure 11:
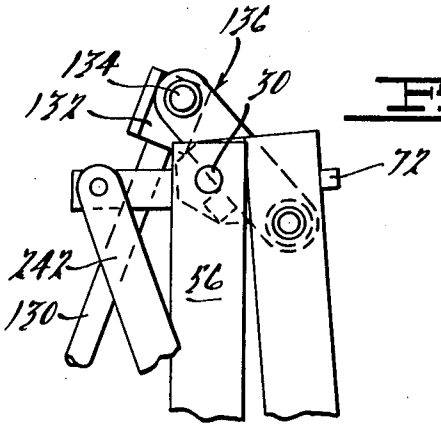
FIG. 11 is an enlarged fragmentary view of the portion of FIG. 3 enclosed in the circle 11 but showing the apparatus in an intermediate dumping position.
Figure 12:
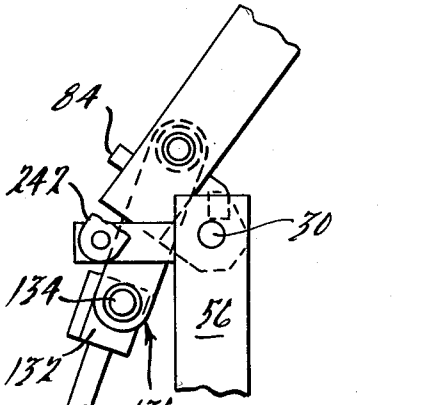
FIG. 12 is a view similar to FIG. 11 but showing the apparatus in the full dump position.

The rocker frame 32 is generally U-shaped in plan and fits loosely between the horizontal, forwardly extending members 72 and 74 of the lift frame 28 immediately ahead of the cross member 82. As perhaps best shown in FIG. 4, the two arm members 174 and 176 of the U-shaped rocker frame 32 carry fixed pivots 178 and 180 that extend outwardly therefrom through bushings 182 and 184 retained in aligned openings 190 and 192 in the lift frame arms 72 and 74 adjacent to the free ends of the latter. Fixed tubular spacers 186 and 188 surround projecting portions of the bushings at the outer sides of the arms 72 and 74 for reasons that will be hereinafter apparent. In this connection, reference is had to FIGS. 4 and 10. FIG. 10 which shows the near arm 174 of the rocker frame 32, as viewed in FIG. 1, and the pivotal connection between the arm 174 and the lift frame horizontal arm member 72. Both of the pivot connections between the rocker frame 32 and the lift frame 28 are shown in FIG. 4. Cross pins 194 and 196 connect the inner ends of the pivots 178 and 180 to the rocker frame arms 174 and 176 so that the pivots turn in the bushings 182 and 184 as the rocker frame 32 turns on the pivots. It will be observed also that the rocker frame 32 fits well back between the lift frame arms 72 and 74 but that sufficient clearance is provided between the rear bight member 198 of the rocker frame and the lift frame cross member 82 to assure that there is no interference therebetween and to permit the rocker frame to turn freely relative to the lift frame 28. Further, as perhaps best shown in FIGS. 1 and 4, the rocker frame arms 174 and 176 extend forwardly beyond the lift frame arms 72 and 74 and the projecting portions of the rocker frame arms 174 and 176 are provided with outwardly extending supports 200 and 202 to which the clamping arms 34 and 36 are pivotally attached. Here again, the supports 200 and 202 are spaced sufficiently forwardly of the lift frame arms 72 and 74 to provide adequate clearance so that there is no interference between the rocker frame 32 and the lift frame arms 72 and 74 as the rocker frame turns on the pivots 178 and 180.

Now with particular reference to the mode of attachment of the clamping arms 34 and 36 to the rocker frame 32 it will be observed (FIG. 13) that, in the particular construction here shown by way of illustration, vertically spaced pairs of hinge knuckles 204 and 206 extend forwardly from each mounting plate 208 and 210 which in turn are attached to the ends of the supports 200 and 202. The two clamping arms 32 and 34 are of curved configuration to conform at least generally to the cross sectional shape of the trash container 38; and hinge blocks or knuckles 212 and 214 provided on the inner ends of the clamping arms 34 and 36 fit between respective rocker frame knuckles 208 and 210 and are attached thereto by hinge pins 216 (FIG. 13). Thus, the clamping arms 32 and 34 swing to and from each other about the hinge pins 216; and, when in the innermost position, the clamping arms snugly fit and clampingly engage but do not entirely surround the trash can or container 38 (FIGS. 2 and 4).

Now with reference to the means for actuating the clamping arms 34 and 36 into and out of engagement with a trash container 38, it will be observed that inward and outward swinging movement of the clamping arms on the hinge pins 216 is accomplished by a power cylinder 218 which is disposed between and fixed to the rocker frame arms 174 and 176. A piston rod 220 extending forwardly from the power cylinder 218 carries a yoke 222 having horizontally extending arms 224 and 226 that are pivotally attached at 228 and 230 to vertically spaced levers 232 and 234 on and extending inwardly from respective clamping arms 34 and 36. When the piston rod 220 is advanced by the power cylinder 218, the yoke 222 acts through the levers 232 and 234 to operate the clamping arms 32 and 34, as shown in FIG. 4. In their open position, the clamping arms 34 and 36 accommodate a trash can 38 therebetween. Contrariwise, when the piston rod 220 is retracted by the power cylinder 218, the yoke 222 on the end of the rod acts through the levers 232 and 234 to swing the clamping arms 32 and 34 toward each other and into tight fitting clamping engagement with the trash can 38. If desired, the clamping arms 32 and 34 may be equipped with suitable gripping pads 236 of rubber or the like which adapt the arms to the shape and contour of the trash can 38 and provide a firm grip of the clamping arms on the can which prevents the latter from falling away from between the arms when in the inverted position shown in FIG. 2.

In operation, a truck equipped with the trash dumping apparatus of this invention is driven alongside a trash can 38 to be emptied with the clamping arms 32 and 34 spread apart or opened, as shown in FIG. 1. At this time, the advance frame 20 is in the retracted position on the truck rails 22 and 24. The clamping arms 34 and 36 are spaced laterally away from the trash can 38 but are sufficiently close thereto so that, when the advance frame 20 is moved forwardly or laterally outwardly on the rails 22 and 24 away from the truck, the clamping arms 34 and 36 move into embracing relation with the can. The power cylinder 218 is then retracted to swing the clamping arms 34 and 36 inwardly toward each other and into clamping engagement with opposite sides of the trash can 38. It will be readily appreciated in this connection that the clamping arms 32 and 34 need not necessarily conform exactly to the contour of the trash can 38 since the curved configuration of the clamping arms give it a gathering action that tends to center the can properly therebetween. As the clamping arms 34 and 36 gather in the trash can 38 in the manner described, the pads 236 not only exert a gripping force against the sides of the can but they also, by their flexible and resilient action, adapt the clamping arms to minor differences in size and shape of trash cans. Thereafter, the power cylinder 108 is operated to retract the piston rod 130 so as to swing the lift frame 28 counterclockwise in the manner hereinabove described to swing the trash can 38 gripped by the arms 32 and 34 overhead to empty the contents of the can into the truck body 40.

During the trash can emptying operation, it is desirable that the trash can 38 remain generally upright at least during approximately the first half of the upward swinging movement and that the can then tilt only slightly inwardly as the lift frame 28 moves farther toward the can emptying position 164 (FIG. 2). However, as the lift frame 28 completes its can emptying movement, it is desirable that the can 38 be turned upside down with a relatively rapid motion; viz., to achieve a flip action of the can as it moves to the fully inverted position over the truck body 40 in order to prevent the contents of the can from being emptied prematurely.

The desired flip motion of the trash can 38 is achieved according to the present invention by a pair of compound levers 238 and 240 at opposite sides of the extend frame 20. Each pair of levers 238 and 240 is pivotally connected at one end to the extend frame adjacent to the upper end thereof and fixedly connected at the other end thereof to the rocker frame pivots 178 and 180. More particularly, each of the compound levers 238 and 240 comprises a generally upright, relatively elongate link 242 the lower end of which is hingedly connected at 244 to a generally horizontal, relatively short link 246. At their upper ends, the links 242 are connected by a pivot 248 to a rearwardly extending L-shaped arm 250 which is attached to one of the extend frame vertical members 56 and 58, as shown in FIG. 8. The pivots 248 are journaled in bushings 252 carried by the arms 250. Enlarged heads 254 on the pivots 248 butt against the inner sides of the arms 250 and the adjacent ends of the bushings 252. The terminal portions of the pivots 248 at the ends thereof remote from the heads 254 extend through and are attached by cross pins 256 to the links 242. The links 242 are sufficiently long to position the relatively short links 246 in-line with the rocker frame pivots 178 and 180, and the outer terminal portions of these pivots extend through and are each attached to the forward end of respective short link 246. In the particular form of the invention here shown by way of illustration, the terminal portions of the pivots 178 and 180 are of square configuration in cross-section, and the holes in the rocker arms 174 and 176 and in the two relatively short link members 246 into which they fit are generally square in cross section so as to reinforce the cross pin connections to assure fixed unions between the connections 194 and 196 and the rocker frame arms 174 and 176 and between the connections 194 and 192 and the short link arms 246 and therefore rocking or turning movement of the rocker frame 32 in unison with the link members 246.

By reason of the arrangement last described, the compound levers 238 and 240 mechanically control the pivotal position of the rocker frame 32 in the lift frame 28; and the arrangement is such that the clamping arms 34 and 36 are substantially horizontal when the lift frame is in the fully lowered position shown in FIG. 1 and remain generally horizontal during the initial upward swinging movement of the lift frame 28 but tilt to a vertical position as the lift frame approaches the dumping position; and, finally, the rocker frame 32 flips over to the near horizontal position shown at 164 in FIG. 2 during the final upward movement of the lift frame. Manifestly, the compound levers 238 and 240 perform the motions above described in reverse order when the lift frame 28 returns to its initial dependent position. Thus, the compound levers 238 and 240 mechanically interlock the extend frame 20 and the rocker frame 32 as the lift frame 28 moves back and forth between the pick-up and dump positions 166 and 164, respectively, in a manner that prevents the trash can 38 from spilling prematurely through inadvertence before the can reaches a position over the truck body 26. At the same time, the compound levers 238 and 240 flip the trash can 38 upside down as the lift frame 28 moves to the final overhead position to assure complete emptying of the container 38; and, further, it accomplishes this without using large numbers of power cylinders, control valves and limit switches and attendant complex piping and wiring heretofore employed by apparatuses of the type involved here. The result is that the dumping mechanism is more trouble-free and is out of commission for servicing or repair less frequently than heretofore. Manifestly, the dumping apparatus is subjected to great physical abuse in use and the moving parts are relatively heavy so that the impact forces developed in operation are great. However, the mechanism employed in the dumping apparatus of this invention is strong and rugged in construction and well able to withstand this abuse and the impact forces involved.

We claim:

1. A trash pick-up and dumping apparatus adapted for mounting on a vehicle having an open-top, trash-receiving body, said apparatus comprising support means adapted to be mounted on said vehicle alongside the trash receiving body thereof;

lift frame means connected to said support means by first horizontal pivot means normally dependent from and swingable vertically from the latter;

rocker frame means connected to said lift frame means below said first pivot means by second horizontal pivot means, said rocker frame means being movable bodily with said lift frame means and also independently rockable about a horizontal axis defined by said second pivot means;

first power actuator means operatively connected to said lift frame means to swing the same and said rocker frame means vertically about said first pivot means;

trash-container-engaging-means carried by said rocker frame means in front of said lift frame means and said support means; and lever means interacting between said support means and said rocker frame means actuated automatically by vertical swinging movement of said lift frame means to rock said rocker frame means on said second pivot means first in one direction to hold said rocker frame means and said trash-container-engaging means generally horizontal and a trash container carried by the latter in generally upright orientation during a first portion of upward swinging movement of said lift frame means and to rock said rocker frame means in the opposite direction about said second pivot means during a subsequent portion of the upward swinging movement of said lift frame means to flip said trash container upside down behind said support means;

said first power actuator means including a crank arm means pivotally connected at one end thereof to said lift frame means adjacent to said first horizontal pivot means; and means forming a part of said lift frame means below and supporting said crank arm means intermediate said first horizontal pivot means and the pivot connection between said crank arm means and said lift frame means during at least a portion of the vertical swinging movement of said lift frame means.

2. A trash pick-up and dumping apparatus as defined by claim 1, wherein said first power actuator means further includes a power cylinder pivotally connected to said support means and to the opposite end of said crank arm means.

3. A trash pick-up and dumping apparatus adapted for mounting on a vehicle having an open-top, trash-receiving body, said apparatus comprising support means adapted to be mounted on said vehicle alongside the trash receiving body thereof;

lift frame means connected to said support means by first horizontal pivot means normally dependent from and swingable vertically from the latter;

rocker frame means connected to said lift frame means below said first pivot means by second horizontal pivot means, said rocker frame means being movable bodily with said lift frame means and also independently rockable about a horizontal axis defined by said second pivot means;

first power actuator means operatively connected to said lift frame means to swing the same and said rocker frame means vertically about said first pivot means;

trash-container-engaging-means carried by said rocker frame means in front of said lift frame means and said support means; and lever means interacting between said support means and said rocker frame means actuated automatically by vertical swinging movement of said lift frame means to rock said rocker frame means on said second pivot means first in one direction to hold said rocker frame means and said trash-container-engaging means generally horizontal and a trash container carried by the latter in generally upright orientation during a first portion of upward swinging movement of said lift frame means and to rock said rocker frame means in the opposite direction about said second pivot means during a subsequent portion of the upward swinging movement of said lift frame means to flip said trash container upside down behind said support means;

said lift frame means normally depending from said first pivot means and being swingable upwardly through an arc of substantially 180°;

said first power actuator means being pivotally connected to said support means and including a reciprocally driven member; and at least one crank arm means pivotally connected to said reciprocally driven member and to said lift frame means adjacent to and below said first pivot means; and wherein said lift frame means includes means forming an abutment below said crank arm means engageable by the latter during at least a portion of its pivotal movement during reciprocation of said first power actuator means in a direction to swing said lift frame means upwardly from its normally dependent position.

4. A trash pick-up and dumping apparatus as defined by claim 3 wherein said reciprocally driven member comprises the piston rod of a power cylinder, and wherein said power cylinder is pivoted to said support means and said piston rod is pivoted to said crank arm means.

5. A trash pick-up and dumping apparatus as defined by claim 3, wherein the arrangement of the pivot connections of said reciprocally driven member and of said lift frame means with said crank arm means and the disposition of said abutment relative to said pivot connections and said crank arm means is such that said crank arm means seats upon and is supported by said abutment during an intermediate portion of the vertical swinging movement of said lift frame means, and wherein said crank arm means is free from engagement with said abutment during initial and final vertical swinging movement of said lift frame.

6. A trash pick-up and dumping apparatus as defined by claim 5, wherein said lever means comprises at least one pair of pivotally interconnected links, one of said links being pivoted to said support means and the other of said links being fixed to said second horizontal pivot means, said lever means being operative to turn said rocker frame in said one direction during initial vertical upward swinging movement of said lift frame means and being operative to turn said rocker frame means in said opposite direction during final vertical upward movement of said lift frame means.

7. A trash pick-up and dumping apparatus of the type adapted for mounting on a vehicle having an open-top, trash-receiving body comprising vertical support means adapted to be mounted on said vehicle alongside the trash-receiving body thereof;

lift frame means disposed alongside said vertical support means and connected thereto at the upper end thereof by horizontal pivot means;

means carried by said lift frame means below said horizontal pivot means for engaging and detachably holding a trash container;

power actuator means for swinging said lift frame means about said horizontal pivot means to dump said trash container into the trash-receiving body of a vehicle on which said trash pick-up and dumping apparatus is mounted, said power actuator means including crank arm means pivotally connected to said lift frame means below said horizontal pivot means, and means forming a part of said lift frame means supporting said crank arm means intermediate said horizontal pivot means and the pivot connection between said crank arm means and said lift frame means during at least a portion of the vertical swinging movement of said lift frame means.

8. A trash pick-up and dumping apparatus of the type adapted for mounting on a vehicle having an open-top, trash-receiving body comprising vertical support means adapted to be mounted on said vehicle alongside the trash-receiving body thereof;

lift frame means disposed alongside said vertical support means and connected thereto by horizontal pivot means, said lift frame means normally depending from said horizontal pivot means and being swingable upwardly through an arc of substantially 180°;

means carried by said lift frame means below said horizontal pivot means for engaging and detachably holding a trash container; and power actuator means for swinging said lift frame means about said horizontal pivot means to dump said trash container into the trash-receiving body of a vehicle on which said trash pick-up and dumping apparatus is mounted, said power actuator means including crank arm means pivotally connected to said lift frame means below said horizontal pivot means, drive means for turning said crank arm means on its pivot connection with said lift frame means, and means forming an abutment below said crank arm means engageable by the latter during at least a portion of the turning movement thereof by said drive means in a direction to swing said lift frame means upwardly from its normally dependent position.

9. A trash pick-up and dumping apparatus as defined by claim 8 wherein said drive means comprises a power cylinder carried by said vertical support means, said power cylinder including a reciprocally driven member pivotally connected to said crank arm means and operative to turn the latter on its pivot connection with the lift frame means forcefully against said abutment to effect upward swinging movement of said lift frame means.

* * * * *